US008668463B2

(12) United States Patent
Yilmaz

(10) Patent No.: US 8,668,463 B2
(45) Date of Patent: Mar. 11, 2014

(54) ROTATABLE COMPONENT MOUNT FOR A GAS TURBINE ENGINE

(75) Inventor: Cagdas Yilmaz, Moodus, CT (US)

(73) Assignee: United Technologies Corporation, Hartford, CT (US)

( * ) Notice: Subject to any disclaimer, the term of this patent is extended or adjusted under 35 U.S.C. 154(b) by 812 days.

(21) Appl. No.: 12/846,371

(22) Filed: Jul. 29, 2010

(65) Prior Publication Data

US 2012/0027601 A1 Feb. 2, 2012

(51) Int. Cl.
*F01D 25/28* (2006.01)

(52) U.S. Cl.
USPC ..... 416/244 A

(58) Field of Classification Search
USPC ..... 403/335, 337; 415/216.1; 416/204 R, 416/204 A, 205, 244 A, 244 R
See application file for complete search history.

(56) References Cited

U.S. PATENT DOCUMENTS

| | | | | |
|---|---|---|---|---|
| 4,304,310 | A | 12/1981 | Garrett | |
| 5,593,277 | A | 1/1997 | Procter et al. | |
| 6,148,494 | A | 11/2000 | Bauer et al. | |
| 6,290,442 | B1 | 9/2001 | Peterkort | |
| 6,457,936 | B1 | 10/2002 | Leach et al. | |
| 7,037,027 | B2 | 5/2006 | Steinbeck | |
| 2009/0290976 | A1 | 11/2009 | Suciu et al. | |
| 2009/0317229 | A1 | 12/2009 | Suciu et al. | |
| 2009/0324396 | A1 | 12/2009 | Short et al. | |
| 2010/0021286 | A1 | 1/2010 | Somanath et al. | |
| 2010/0232969 | A1 * | 9/2010 | Behnke et al. | 416/204 R |
| 2012/0126661 | A1 * | 5/2012 | Ketner et al. | 310/228 |
| 2013/0017068 | A1 * | 1/2013 | Baumann et al. | 415/170.1 |

* cited by examiner

*Primary Examiner* — Nathaniel Wiehe
*Assistant Examiner* — Woody A Lee, Jr.
(74) *Attorney, Agent, or Firm* — O'Shea Getz P.C.

(57) ABSTRACT

Radial shifting of a rotatable component in a gas turbine engine is prevented by radially offsetting overlying mounting apertures in said component and a base or mounting flange therefor such that fasteners received within said overlying apertures are radially interference fit within the apertures thereby eliminating the necessity of machining or otherwise forming the apertures to an exact fit with the fasteners.

19 Claims, 3 Drawing Sheets

ROTATABLE COMPONENT MOUNT FOR A GAS TURBINE ENGINE

BACKGROUND OF THE INVENTION

1. Technical Field

This invention relates generally to gas turbine engines and particularly to an arrangement for mounting a rotatable component on the rotor of such a gas turbine engine.

2. Background Information

Gas turbine engines, such as those which power aircraft, employ a stator which supports stationary components of the engine, such as vanes which direct the flow of air and combustion gases through the engine, and a rotor of the stator on which rotatable components such as fan, compressor and turbine blades are mounted. Such blades are ordinarily mounted on hubs therefore which are fixed to one or more rotor shafts which extend through the interior of the stator. It is a common practice to mount such hubs on mounting flanges or bases which are either fixed to the rotor shaft or integrally formed therewith. Such hubs are typically fixed to the associated mounting flanges or bases in arrangements wherein elongate fasteners such as bolts extend through overlying apertures in the hubs and associated mounting flanges. Consistent with known manufacturing techniques, it is a common practice to provide the mounting holes in the hubs and flanges that are slightly larger than the cross-sectional areas of the bolts which extend therethrough to allow the bolts to be inserted in the apertures without binding thereon. This arrangement defines a clearance between the bolts and the mounting apertures. Under operating conditions such as surge events wherein the engine rotor experiences a radial imbalance of working fluid flow, the presence of such clearances between the bolts and mounting apertures allow a radial shift of the hub on the mounting flange, inducing a radial imbalance in the rotor, resulting in whirl which can damage the rotor by a bending of the shaft or a mechanical failure of the bearings on which the shaft is mounted. Accordingly, it is imperative that such radial imbalances in the rotor be avoided as much as possible. One known method for avoiding such radial imbalances caused by a shifting of the hub on the mounting flange is to entirely eliminate the clearances between the mounting bolts in the apertures and the hub and flange through which the bolts extend. Such clearances may be eliminated by forming the apertures with precisely the same area as the bolt shanks. However, such arrangements add substantially to engine rotor engine rotor manufacturing efforts quality control problems and therefore costs, requiring extreme precision in the formation of the mounting apertures and difficulty in insertion of the bolts into such apertures due to the bolts binding on the interior surfaces of the apertures when inserted therethrough.

Accordingly, an arrangement for mounting a rotatable component on a gas turbine engine rotor which minimizes the risk of any radial imbalance of the rotor due to radial shifting of the component on a mounting flange or base therefor without requiring excessive precision in the formation of mounting apertures and increase costs associated with the assembly of such a mounting arrangement due to a lack of clearance between the mounting bolts and the apertures within which such bolts are received, is sought.

SUMMARY OF THE DISCLOSURE

In accordance with the present invention, a rotatable component such a blade hub is mounted on a mounting flange or base disposed on a rotor shaft of a gas turbine engine by elongate fasteners such as bolts received within an arrangement of overlying apertures in the component and base wherein the apertures in one of the component and base are slightly radially offset from the underlying apertures in the other of the component and base to partially radially close the underlying apertures in the other of the component and base (i.e., reduce the aligned area between the apertures in the component and those in the base) such that the fasteners are disposed in a radial interference fit within the apertures. As used herein, "radial interference fit" shall mean that the radially inner and outer surfaces of the fasteners are disposed in generally surface-to-surface contact with the radially inner and outer interior surfaces of the apertures within which the fasteners are received to eliminate radial clearances between the fasteners and the apertures therefor. Since the radial clearances between the fasteners and apertures within which the fasteners are received are eliminated, radial shifting of the component in response to radially imbalanced loads on the engine's rotor blades due to, for example, engine surge, are minimized, thereby minimizing the risk of damage to the engine's rotor from such conditions. Elimination of the radial clearances between the fasteners and apertures is achieved by radially offsetting the apertures in the rotatable component from the apertures in the mounting flange or base therefor. In a preferred embodiment, the apertures and one of the rotatable component and base are disposed in a circular array having a radius $R_1$ while the apertures in the other of said component and base are staggered around opposite sides of a circular line of radius $R_1$ such that a first set of apertures is disposed in a circular array disposed at a radius $R_2$ which is slightly less than $R_1$ and a second set of apertures in the other of said component and base are disposed in a circular array at a radius $R_3$ from the axis of rotation of the engine's rotor wherein $R_3$ is slightly greater than $R_1$. The first set of apertures alternate circumferentially with the second set of apertures so that the radial loads on the fasteners received within the apertures are generally evenly distributed around the circumference of the rotatable component and underlying flange.

The radial component may comprise any of the components normally mounted on the engine's shaft such as any of various bladed hubs (either integrally bladed or with separate, attached blades) in the engine's fan compressor or turbine. The mounting arrangement of the present invention is conveniently implemented by aligning the rotatable component with the underlying mounting flange or base such that the mounting apertures are in radial alignment with one another fixturing the rotatable component and then sequentially heating and cooling the rotatable component to achieve the radial offset of the apertures in that component with those in the underlying mounting flange or base.

DETAILED DESCRIPTION OF THE INVENTION

Figure 1:
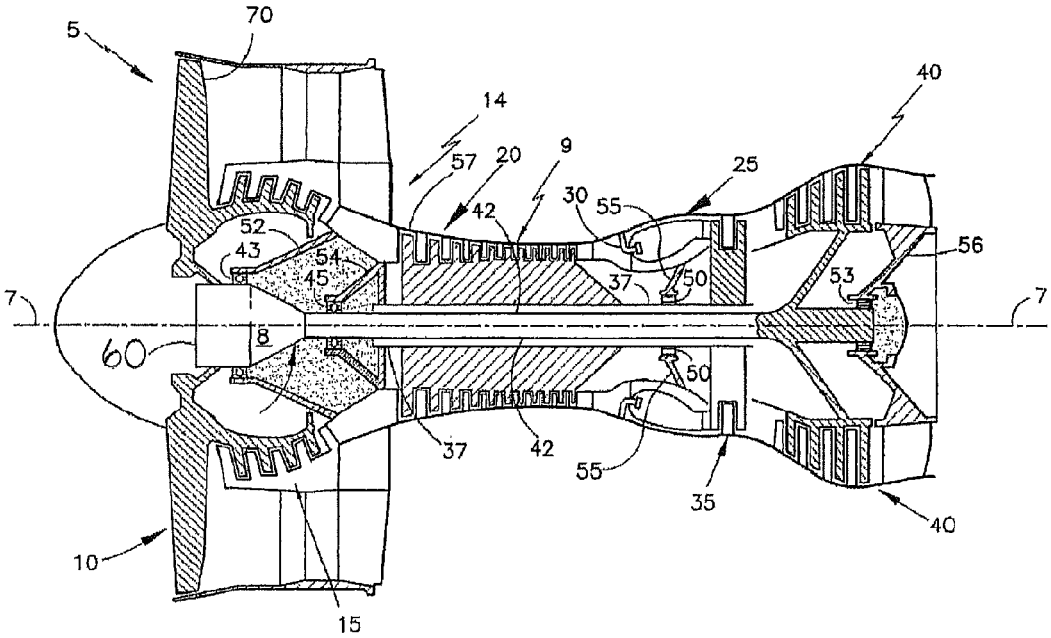
FIG. 1 is a schematic view of a turbofan gas turbine engine of the type employing the present invention.

Referring to FIG. 1, a turbofan gas turbine engine 5 has a longitudinal axis 7 about which the rotors 8 within stator 9 rotate which circumscribes the rotors. A fan 10 disposed at the engine inlet draws air into the engine. A low pressure compressor 15 located immediately downstream of fan 10 compresses air exhausted from fan 10 and a high pressure compressor 20 located immediately downstream of low pressure compressor 15, further compresses air received therefrom and exhausts such air to combustors 25 disposed immediately downstream of high pressure compressor 20. Combustors 25 receive fuel through fuel injectors 30 and ignite the fuel/air mixture. The burning fuel-air mixture (working medium fluid) flows axially to a high pressure turbine 35 which extracts energy from the working medium fluid and in so doing, rotates hollow shaft 37, thereby driving the rotor of high pressure compressor 20. The working medium fluid exiting the high pressure turbine 35 then enters low pressure turbine 40, which extracts further energy from the working medium fluid. The low pressure turbine 40 provides power to drive the fan 10 and low pressure compressor 15 through low pressure shaft 42, which is disposed interiorly of the hollow shaft 37, coaxial thereto. Working medium fluid exiting the low pressure turbine 40 provides axial thrust for powering an associated aircraft (not shown) or a free turbine (also not shown).

Bearings 43, 45, 50 and 53 radially support the concentric high pressure and low pressure turbine shafts from separate frame structures 52, 54, 55 and 56 respectively, attached to engine case 57, which defines the outer boundary of the engine's stator 9 which circumscribes rotors 8. However, it will be appreciated that the present invention is also well suited for mid-turbine frame engine architectures wherein the upstream bearings for the low and high pressure turbines are mounted on a common frame structure disposed longitudinally (axially) between the high and low pressure turbines.

Figure 2:
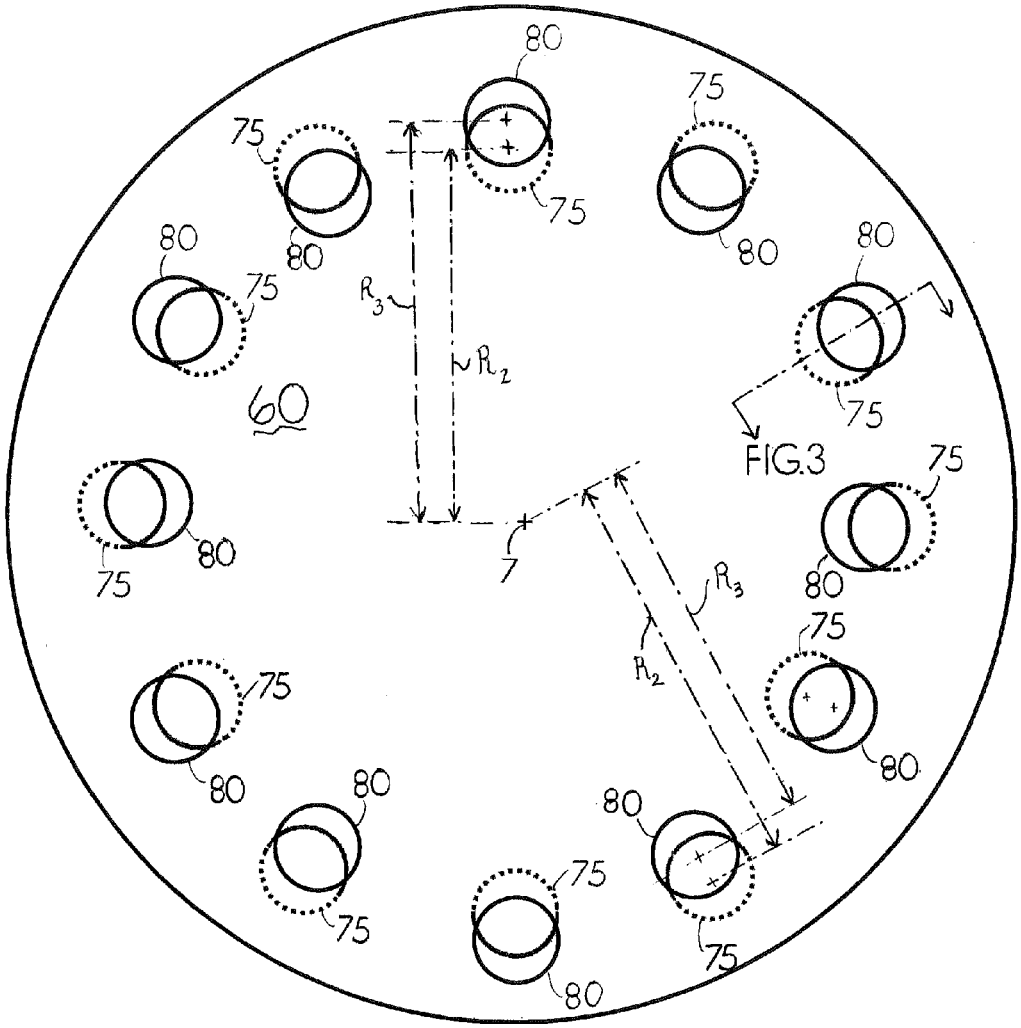
FIG. 2 is a schematic front sectional view of a hub that is included in the rotatable component mounting arrangement of the present invention.
Figure 3:
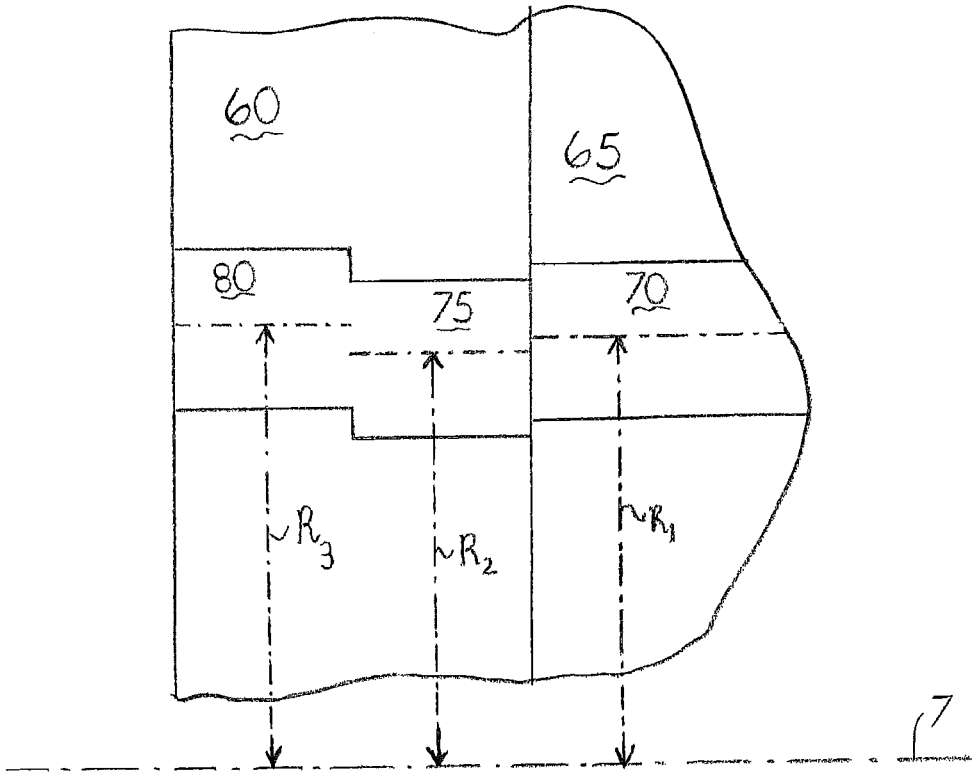
FIG. 3 is a schematic side sectional view of the rotatable component mounting arrangement of the present invention.

Referring to FIGS. 1-3, a rotatable component 60 such as a hub for the engine's fan, compressor or turbine is disposed in overlying relationship to an underlying base or mounting flange 65 (see FIG. 3) which is fixed to one of the engine's shafts (see FIG. 1) by any suitable technique such as welding or brazing or formed integrally therewith. Flange 65 is provided with a plurality of apertures 70 (see FIG. 3) disposed in a circular array at a radius $R_1$ (see FIG. 3) from an axis of rotation 7. Hub 60 is provided with an equal number of apertures 75 and 80 which are disposed in a generally circular array except that apertures 75 are disposed at a radius $R_2$ (which in FIG. 3 is slightly less than radius $R_1$) and apertures 80 are located at a radius $R_3$ (which in FIG. 3 is slightly greater than radius $R_1$) Apertures 75 and 80 alternate with one another and are staggered about a circular line of radius $R_1$ such that portions of hub 60 which surround apertures 75 and 80 partially radially close apertures 70 in mounting flange 65. By radially displacing apertures 75 and 80 from the location of underlying apertures 70 in the manner described herein, portions of hub 60 which surround apertures 75 and 80 partially close apertures 70 in mounting flange 65 (i.e., reduce the aligned area between the apertures in the component and those in the base). A plurality of elongate fasteners such as bolts (not shown) extend through overlying pairs of apertures 70, 75 and 80, and in conjunction with mating and nuts (not shown) clamp hub 60 to mounting flange 65. Partially closing apertures 70 in mounting flange 65 in the manner described, allows bolts to be maintained in radially interference fit with the overlying pairs of apertures in which they are received. As used herein, interference fit shall mean that the bolts are placed in surface-to-surface contact with the radially inner and outer surfaces of apertures 70, 75 and 80 so that in the event of unbalanced radial loading of hub 60 due to for example an operational anomaly such as engine surge, hub 60 is prevented from radially shifting with respect to mounting flange 65. Since the bolts are received in the overlying apertures in the flange and hub in a radial interference fit, there is no need to machine apertures 70, 75 and 80 to a precision fit with bolts to eliminate any clearance between the bolts and the apertures which would be required with prior art manufacturing techniques. Accordingly, the apertures 70, 75 and 80 may be machined in hub 60 and mounting flange 65 with normal tolerances thereby rendering the mounting arrangement herein implementable in a simple and cost-effective manner. That is, the radial displacement of apertures 75 and 80 with respect to aperture 70 is conveniently accomplished by providing apertures 70, 75 and 80 in hub 60 and flange 65 with normal manufacturing tolerances, inserting bolts into the aligned apertures, fixturing one of the flange or hub and heating the other of the flange or hub to radially offset apertures 75 and 80 with respect to aperture 70 thereby placing bolts in the above-described interference fit with the pairs of overlying apertures.

While the present invention has been described within the context of mounting a bladed hub for a fan compressor or turbine stage on mounting flange disposed on gas turbine engine shaft, it will be appreciated that the present invention may be employed with equal efficacy for mounting any rotatable component on a gas turbine engine shaft. While the invention has been described and illustrated with twelve pairs of overlying apertures in the flange and hub, it will be appreciated that the exact number of apertures and size thereof will be determined by the size of the hub and mounting flange which will in turn be determined by the performance requirements of the engine in which the present invention is implemented. While the elongate fasteners have been described as bolts, it will be appreciated that equivalent fasteners, such as rivets, pins or other elongate fasteners, may be employed. Accordingly, it will be understood that various modifications to the preferred embodiment described herein may be made without departing from the present invention and it is intended by the appended claims to cover such modifications as fall within the true spirit and scope of the invention.

Having thus described the invention, what is claimed is:

1. A mounting arrangement for a gas turbine engine, comprising:

a component adapted to rotate about an axis of rotation of the gas turbine engine, the component being mounted on a rotatable base by at least a pair of fasteners extending through overlying apertures in the component and the base, the overlying apertures including apertures in the base being disposed at a radius R1 from the axis of rotation, the overlying apertures including apertures in the component being disposed at a radius R2 from the axis of rotation, and the overlying apertures including apertures in the component being disposed at a radius R3 from the axis of rotation, wherein one of the radii R2 and R3 is greater than the radius R1 and one of the radii R2 and R3 is less than the radius R1.

2. The mounting arrangement of claim 1, wherein the component comprises a bladed hub.

3. The mounting arrangement of claim 2, wherein the bladed hub comprises one of a fan hub, a compressor hub, and a turbine hub.

4. The mounting arrangement of claim 1, wherein the base comprises a mounting flange.

5. The mounting arrangement of claim 1, wherein one of the apertures in the base being disposed at the radius R1, the apertures in the component being disposed at the radius R2, and the apertures in the component being disposed at the radius R3, comprise a plurality of apertures disposed in a circular array.

6. The mounting arrangement of claim 1, wherein the apertures in the component being disposed at the radius R2 and the apertures in the component being disposed at the radius R3 are staggered about a generally circular line having a radius from the axis of rotation that is equal to the radius R1.

7. A mounting arrangement for a rotatable component in a gas turbine engine adapted to rotate about an axis of rotation, the component being mounted on a rotatable base by fasteners extending through overlying apertures in the component and base, the overlying apertures including apertures in the component and apertures in the base, the apertures in the component being radially offset from the apertures in the base, thereby reducing an aligned area between the apertures in the component and the apertures in the base such that the fasteners extending through the overlying apertures are subjected to a radial interference fit within the overlying apertures wherein the overlying apertures include first and second sets of apertures in the component, wherein the first set of apertures in the component are radially offset from the apertures in the base by a first radial direction, and wherein the second set of apertures in the component are radially offset from the apertures in the base by a second radial direction that is opposite of the first radial direction.

8. The mounting arrangement of claim 7, wherein the apertures in the base are disposed in a circular array at a radius R1 from the axis of rotation.

9. The mounting arrangement of claim 8, wherein the first set of apertures in the component is disposed in a circular array at a radius R2 from the axis of rotation, and wherein the radius R2 is less than the radius R1.

10. The mounting arrangement of claim 9, wherein the second set of apertures in the component is disposed in a circular array at a radius R3 from the axis of rotation, and wherein the radius R3 is greater than the radius R1.

11. The mounting arrangement of claim 8, wherein the first and second set of apertures in the component are staggered about a generally circular line having a radius from the axis of rotation that is equal to the radius R1.

12. The mounting arrangement of claim 7, wherein the component is a bladed hub.

13. The mounting arrangement of claim 12, wherein the bladed hub comprises one of a fan hub, a compressor hub, and a turbine hub.

14. The mounting arrangement of claim 7, wherein the base comprises a rotatable flange.

15. A rotor for a gas turbine engine, the rotor being rotatable about an axis of rotation of the gas turbine engine, the gas turbine engine rotor comprising:

a hub mounted on a base by fasteners extending through overlying apertures in the hub and the base;

the overlying apertures including apertures in the base, the apertures in the base being disposed in a circular array a first radius from the axis of rotation;

the overlying apertures including a first set of apertures in the hub, the first set of apertures being radially offset outwardly from the first radius;

the overlying apertures including a second set of apertures in the hub, the second set of apertures being radially offset inwardly from the first radius; and the fasteners being subject to a radial interference fit within the overlying apertures.

16. The gas turbine engine rotor of claim 15, wherein apertures of the first and second sets of apertures of the hub alternate circumferentially.

17. The gas turbine engine rotor of claim 16, wherein apertures of the first and second sets of apertures of the hub are staggered about a circular line at the first radius.

18. The gas turbine engine rotor of claim 17, wherein the fasteners comprise bolts.

19. The gas turbine engine rotor of claim 17, wherein the hub comprises one of a bladed fan hub, a bladed compressor hub, and a bladed turbine hub.

* * * * *